United States Patent [19]

McKelvey

[11] 4,152,095

[45] May 1, 1979

[54] FAN OPERATOR LEVER VIBRATION DAMPENER

[75] Inventor: Wilfred G. McKelvey, Palos Verdes, Calif.

[73] Assignee: Western Engineering & Mfg. Co., Inc., Marina Del Rey, Calif.

[21] Appl. No.: 835,656

[22] Filed: Sep. 22, 1977

[51] Int. Cl.[2] ..... F01D 24/04

[52] U.S. Cl. ..... 415/119; 74/531; 188/1 B

[58] Field of Search ..... 415/119; 74/519, 526, 74/531, 532, 490; 188/1 B

[56] References Cited

U.S. PATENT DOCUMENTS

| | | | |
|---|---|---|---|
| 2,259,415 | 10/1941 | Eddy | 74/531 |
| 2,522,339 | 9/1956 | Bartrug | 74/531 |
| 3,932,054 | 1/1976 | McKelvey | 415/130 |

*Primary Examiner*—Louis J. Casaregola
*Attorney, Agent, or Firm*—Fulwider, Patton, Rieber, Lee & Utecht

[57] ABSTRACT

A fan operator lever vibration dampener for a variable pitch fan whose blade pitch is varied by movement of an elongated operating lever extending through a slot in a wall of the fan. The dampener comprises a pressure plate located between the projecting extremity of the operating lever and one of the slot side margins. The plate is movable toward and away from the lever extremity. Bias means interposed between the lever extremity and the pressure plate tend to urge the lever extremity and pressure plate against the slot margins to prevent vibration.

4 Claims, 3 Drawing Figures

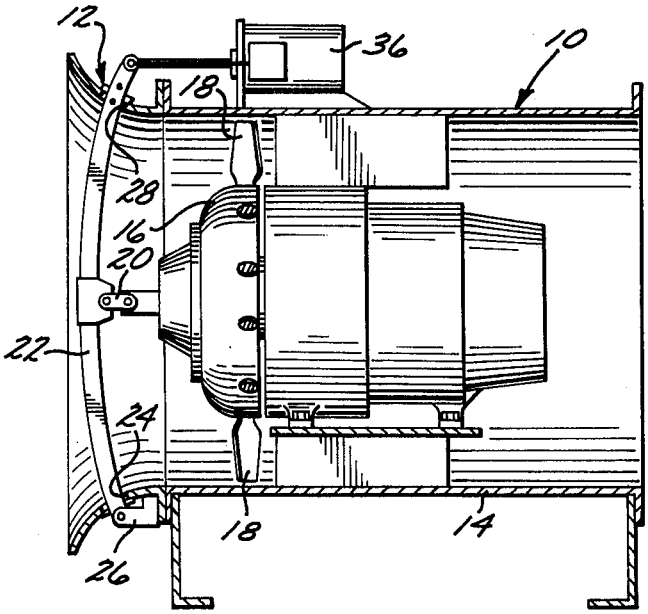
FIG. 1
FIG. 3
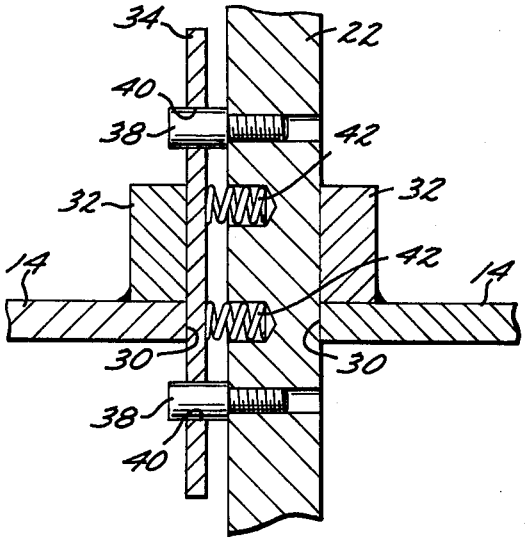
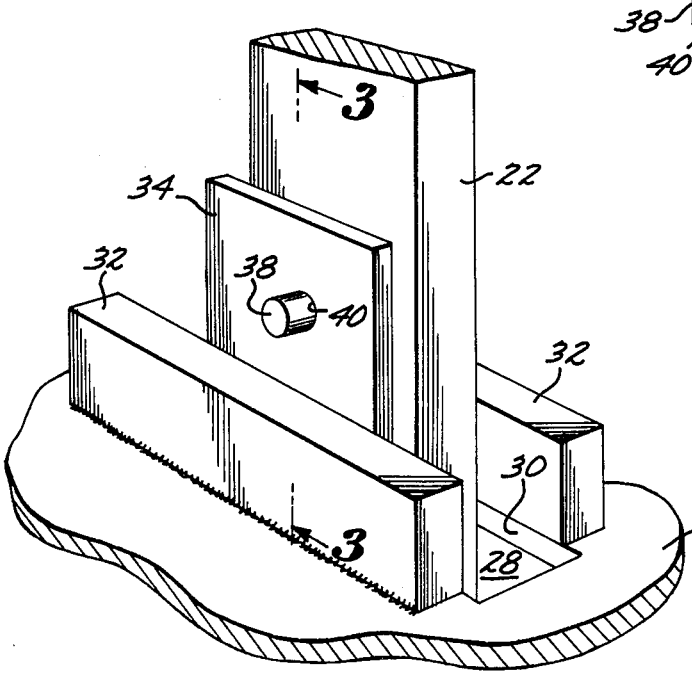
FIG. 2

FAN OPERATOR LEVER VIBRATION DAMPENER

CROSS REFERENCE TO RELATED APPLICATION

The present fan operator lever vibration dampener is particularly suited for operation with the structure set forth in my U.S. Pat. No. 3,932,054, issued Jan. 13, 1976, and entitled VARIABLE PITCH AXIAL FAN.

BACKGROUND OF THE INVENTION

1. Field of the Invention

The present invention relates to a vibration dampener for the fan operator lever of an axial fan.

2. Description of the Prior Art

Certain types of axial fans for air conditioning and the like include an actuator which is operable to vary the pitch of the fan blades. The actuator is operable by an elongated operating lever which extends at one extremity through a slot in the wall which defines the air conduit of the fan. The projecting extremity of the operating lever is movable by an externally located operator. Vibration of the operator lever against the side margins of the slots is a common problem with this type of fan and the vibration undesirably increases the noise level in the area of the fan and on occasion causes failure of the operator.

Various means have been employed to reduce or eliminate such vibration in axial fans and the like, but these have not been completely successful. The solutions heretofore attempted have often undesirably interfered with the free travel of the operating lever through the conduit slot.

SUMMARY OF THE INVENTION

According to the present invention, a vibration dampener is provided which substantially eliminates vibration of the operating lever used in certain types of axial fans to vary the blade pitch. Such an operating lever is coupled to an actuator means which is operable to vary the blade pitch. The operating lever projects through a slot in the fan wall and is movable by an externally located operating means.

The present vibration dampener comprises a pressure plate located between the projecting extremity of the operator lever and the adjacent margin of the slot through which it projects. Guide means mounted to the pressure plate and the lever allows movement of the plate toward and away from the lever.

Compression springs or like bias means interposed between the pressure plate and the lever urge the plate and lever against the margins of the slot, thereby substantially eliminating rattling and vibration of the lever against the slot.

Other objects and features of the invention will become apparent from consideration of the following description taken in connection with the accompanying drawings.

BRIEF DESCRIPTION OF THE DRAWINGS

FIG. 1 is a longitudinal cross-sectional view of a variable pitch axial fan incorporating the vibration dampener of the present invention;

FIG. 2 is an enlarged perspective view of the vibration dampener in position adjacent the operating lever; and FIG. 3 is a view taken along the line 3—3 of FIG. 2.

DESCRIPTION OF THE PREFERRED EMBODIMENT

Referring now to the drawings, there is illustrated a variable pitch axial fan 10 for which the present vibration dampener 12 is particularly suited, although it should be understood that the particular fan 10 is merely exemplary and that the present vibration dampener 12 is also adapted for use with other types of fans in which there is unwanted vibration of an operating lever or the like.

The fan 10 is very similar to that described in my U.S. Pat. No. 3,932,054, and reference is therefore made to that patent for a more detailed description. Generally, the fan 10 comprises a wall 14 defining an air conduit within which is rotatable a hub 16 which mounts a plurality of variable pitch blades 18. The wall 14 is generally cylindrical except for an inlet bell at its upstream end. The downstream end is flanged for connection to the usual conduit of an air conditioning system or the like (not shown).

The pitch of the blades 18 is varied by actuator means, generally indicated at 20, which are pivotally coupled to the mid-portion of an elongated operating lever 22 disposed transversely of the conduit wall 14. The lower extremity of the lever 22 extends through a slot 24 provided in the conduit wall 14 and is pivotally connected to a bracket 26 which is secured to the wall 14. The upper extremity of the operating lever 22 extends through an upper slot 28 defined by side margins 30, as best seen in FIGS. 2 and 3, and also projects beyond a pair of elongated rectangular slot guides 32 which are welded to the wall 14.

The inner confronting faces of the guides 32 constitute an upward continuation of the side margins 30 and, as will be seen, provide bearing areas for the operating lever 22 and a rectangular pressure plate 34.

The fan 10 also comprises an externally located operating means 36 mounted to the wall 14 and coupled to the upper end of the lever 22. Operation of the operating means 36 is effective to move the lever 22 along the length of the slot 28, and this moves the actuator means 20 to vary the pitch of the blades 18, all as more particularly set forth in my U.S. Pat. No. 3,932,054.

The pressure plate 34 is located between the operating lever 22 and the adjacent side margin 30 of the slot 28, and normally is in spaced apart relation to the lever 22.

Guide means in the form of a pair of bolts 38 and complemental openings 40 are carried by the pressure plate 34 and the lever 22 and are operative to constrain the pressure plate 34 against movement relative to the lever 22, except for movement toward and away from the lever 22. More particularly, the bolts 38 are threaded within suitable openings provided in the lever 22 above and below the slot guides 32. The head of each bolt constitutes a cylindrical pin which is axially slidably received within one of the complemental openings 40 provided in the pressure plate 34. With this arrangement, the pressure plate 34 is slidable on the bolt heads or pins, but is otherwise not movable relative to the lever 22.

The pressure plate 34 is biased or urged away from the lever 22 and against the adjacent slot guide 32 and side margin 30 by a pair of bias means in the form of a pair of compression springs 42. Each spring 42 is seated at one end within a suitable blind bore provided in the lever 22, and the opposite end of the spring bears against the confronting surface of the pressure plate 34. The bias acton of the springs 42 thus tends to urge the lever 22 and the pressure plate 34 against the adjacent slot margins 30 and slot guides 32 whereby vibration of the lever against any structure of the fan 12 is substantially eliminated. Such vibration is eliminated without significantly affecting freedom of movement of the operating lever 22 within the slot 28.

Various modifications and changes may be made with regard to the foregoing detailed description without departing from the spirit of the invention.

I claim:

1. In a fan having a wall defining an air conduit; a hub rotatable in said conduit and mounting a plurality of variable pitch blades; actuator means operable for varying the pitch of said blades; an elongated operating lever coupled to said actuator means, and having one extremity extending through a slot in said wall and projecting beyond the margins of said slot to the exterior of said conduit; and operating means operative to move said extremity longitudinally along said slot and thereby move said operating lever for operating said actuator means; a vibration dampener comprising:

a pressure plate located between said extremity of said operating lever and one of said side margins defining said slot, in normally spaced apart relation to said extremity;

guide means carried by said pressure plate and said extremity and constraining said pressure plate against movement relative to said extremity, other than transverse movement toward and away from said extremity; and bias means operative at all times upon said extremity and said pressure plate to urge said extremity and said pressure plate against said margins of said slot, the bias of said bias means being sufficient to substantially eliminate vibration of said extremity relative to said margins, said bias being insufficient to brake said extremity against longitudinal movement relative to said margins.

2. The structure set forth in claim 1 wherein said guide means comprises a plurality of pins secured to one of said pressure plate and said extremity and slidable within complemental openings provided in the other of said pressure plate and said extremity.

3. The structure set forth in claim 1 and wherein said wall includes a pair of slot guides located adjacent said side margins of said slot, said slot guides having confronting faces providing bearing areas for said pressure plate and said extremity, respectively.

4. The structure set forth in claim 1 wherein said bias means comprises a pair of compression springs disposed between said pressure plate and said extremity.

* * * * *